US006951518B2

(12) United States Patent
Solheim et al.

(10) Patent No.: US 6,951,518 B2
(45) Date of Patent: Oct. 4, 2005

(54) GOLF CLUB HEAD HAVING A BI-POLYMER FACE INSERT AND METHOD OF MAKING SAME

(75) Inventors: John K. Solheim, Anthem, AZ (US); David D. Jones, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/764,024

(22) Filed: Jan. 23, 2004

(65) Prior Publication Data

US 2005/0164806 A1 Jul. 28, 2005

(51) Int. Cl.[7] ..... A63B 53/04

(52) U.S. Cl. ..... 473/324; 473/332; 473/342; 473/340; 473/349; 473/409

(58) Field of Search ..... 473/324–350, 473/251–256, 409; D21/736–746

(56) References Cited

U.S. PATENT DOCUMENTS

| | | | | |
|---|---|---|---|---|
| 3,863,932 | A * | 2/1975 | Lezatte | 473/342 |
| 5,924,939 | A * | 7/1999 | Grace et al. | 473/324 |
| 6,083,117 | A * | 7/2000 | Hsu | 473/332 |
| 6,200,229 | B1 * | 3/2001 | Grace et al. | 473/324 |
| 6,273,831 | B1 * | 8/2001 | Dewanjee | 473/324 |
| 6,302,807 | B1 * | 10/2001 | Rohrer | 473/329 |
| 6,406,379 | B1 * | 6/2002 | Christensen | 473/251 |
| 6,425,831 | B1 * | 7/2002 | Heene et al. | 473/332 |
| 6,729,972 | B2 * | 5/2004 | Boord | 473/340 |

FOREIGN PATENT DOCUMENTS

| | | |
|---|---|---|
| GB | 1402796 | 8/1975 |
| JP | 6285190 | 10/1994 |
| WO | 00/38796 | 6/2000 |

* cited by examiner

*Primary Examiner*—Sebastiano Passaniti
(74) *Attorney, Agent, or Firm*—Darrell F. Marquette; John D. Titus

(57) ABSTRACT

A golf club head includes a face insert disposed in a cavity formed in the front face of the club head. The face insert has a front surface for impacting a golf ball and a back surface having a cavity formed therein for receiving a second insert. A second insert, composed of a material different from the first insert, is disposed in the cavity formed in the back of the first insert. Because the edges of the second insert are not exposed, the second insert can be made of very soft materials including silicone rubbers and gels, which would not be suitable for use in an application in which the edges are exposed.

18 Claims, 5 Drawing Sheets

GOLF CLUB HEAD HAVING A BI-POLYMER FACE INSERT AND METHOD OF MAKING SAME

BACKGROUND OF THE INVENTION

This invention relates generally to golf equipment and, in particular, to golf club heads.

U.S. Pat. No. 5,674,132 to Fisher discloses a golf putter head that includes a metal body with a front face and a non-metallic face insert disposed in the front face of the body. The face insert is a multi-layered, laminated structure bonded to the bottom surface of a tapered slot formed in the face of the club head. The use of a laminated face insert permits a composite of the material properties of the laminates to be realized in a single face insert. A drawback of the putter disclosed in the Fisher patent, however, is that since the edges of the insert laminations are exposed, they are easily damaged. Accordingly, soft laminates cannot easily be used in such an application.

SUMMARY OF THE INVENTION

The present invention comprises a golf club head including a club head body, the front face of which has a cavity for receiving a face insert. The face insert, which is disposed in the cavity, has a front surface for impacting a golf ball and a back surface having a cavity formed therein for receiving a second insert. A second insert, composed of a material different from the first insert, is disposed in the cavity formed in the back of the first insert. Because the edges of the second insert are not exposed, the second insert can be made of very soft materials including silicone rubbers and gels, which would not be suitable for use in an application in which the edges are exposed.

BRIEF DESCRIPTION OF THE DRAWING

The present invention will be better understood from a reading of the following detailed description, taken in conjunction with the accompanying drawing figures in which like references designate like elements, and in which.

DETAILED DESCRIPTION

Figure 1:
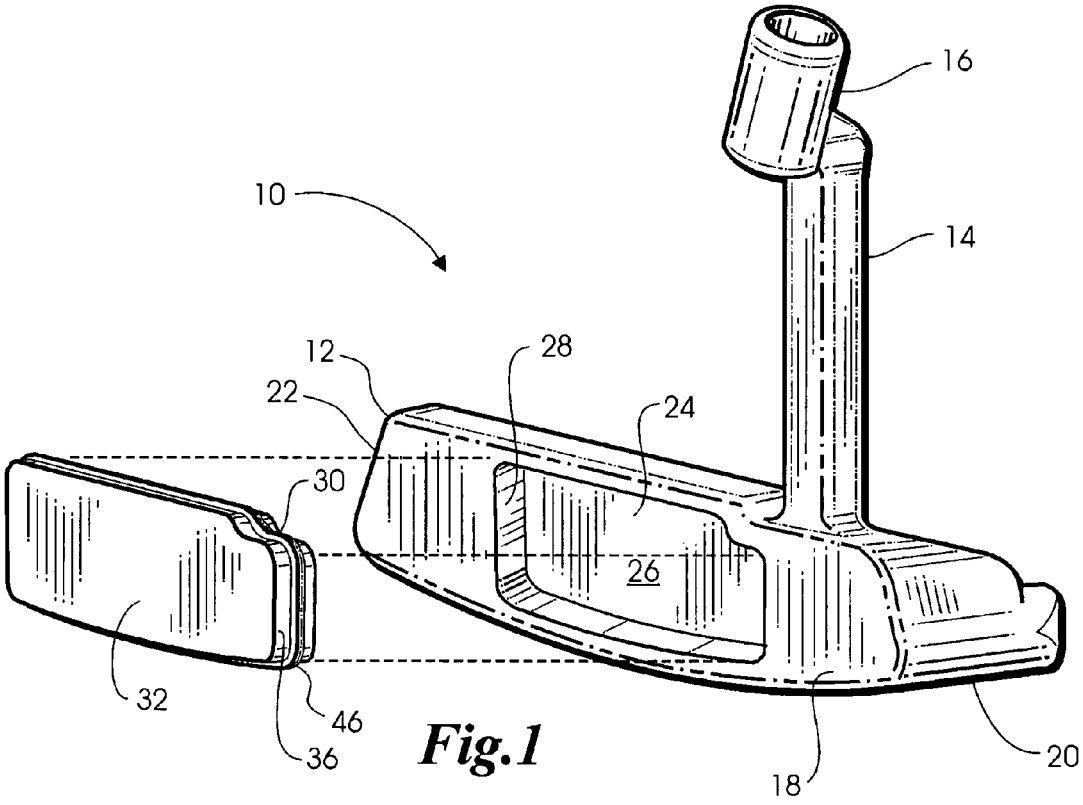
FIG. 1 is an exploded front perspective view of a golf club head incorporating features of the present invention.
Figure 2:
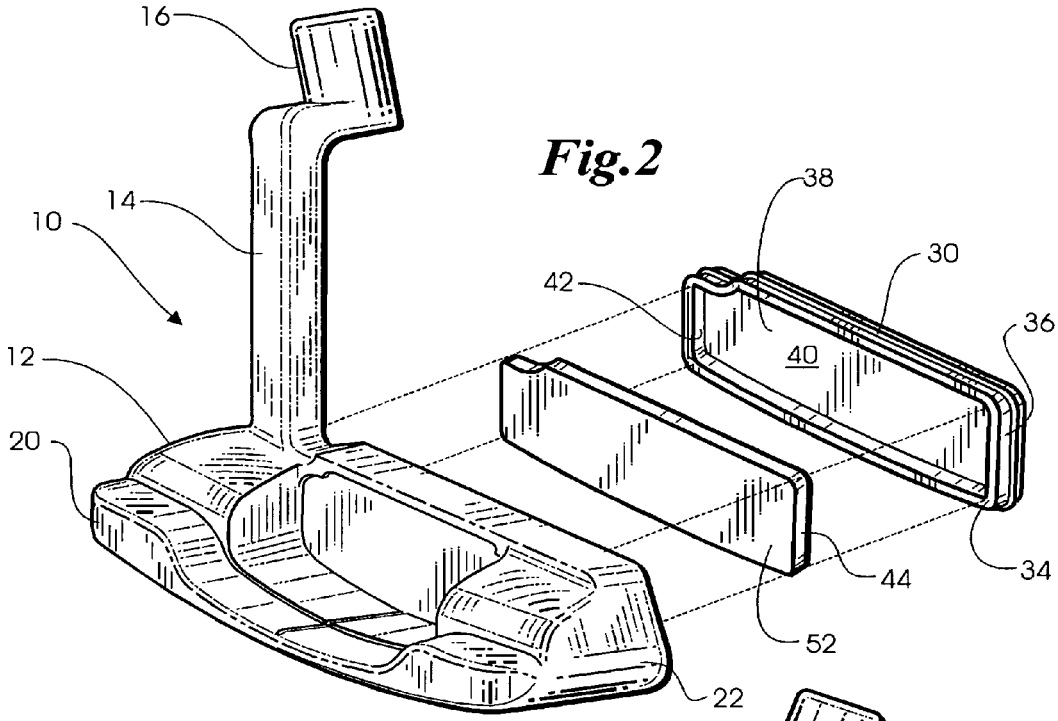
FIG. 2 is an exploded rear perspective view of the golf club head shown in FIG. 1.

With reference to FIGS. 1 and 2, a golf club head 10, preferably a golf putter head, comprises a body 12 and a hosel 14 with a boss 16 counterbored for receiving one end of a golf club shaft (not shown). The body 12 has a front face

Figure 3:
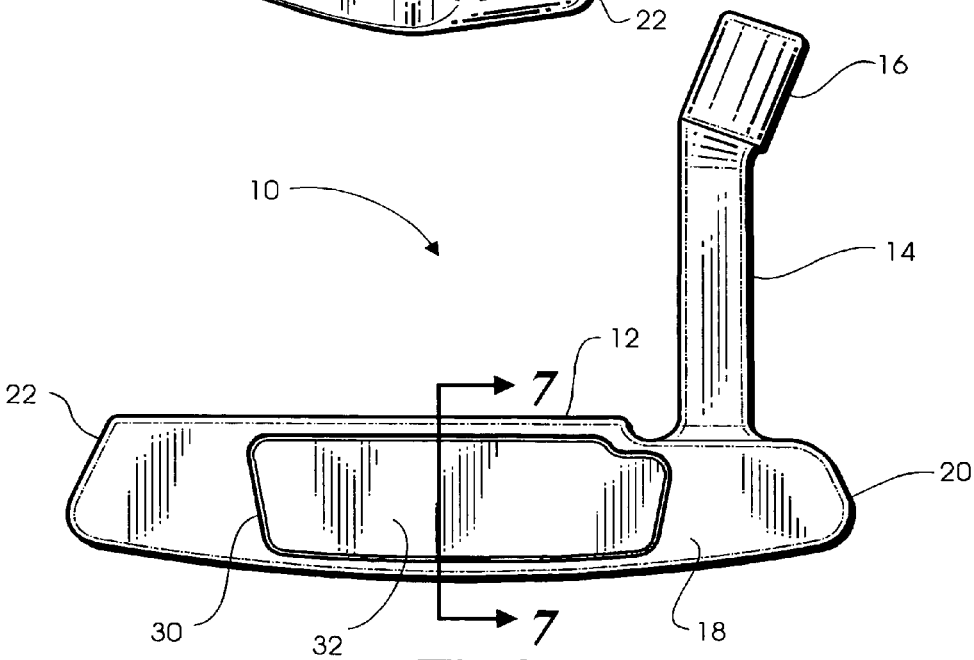
FIG. 3 is a front elevational view of the golf club head shown in FIG. 1.
Figure 4:
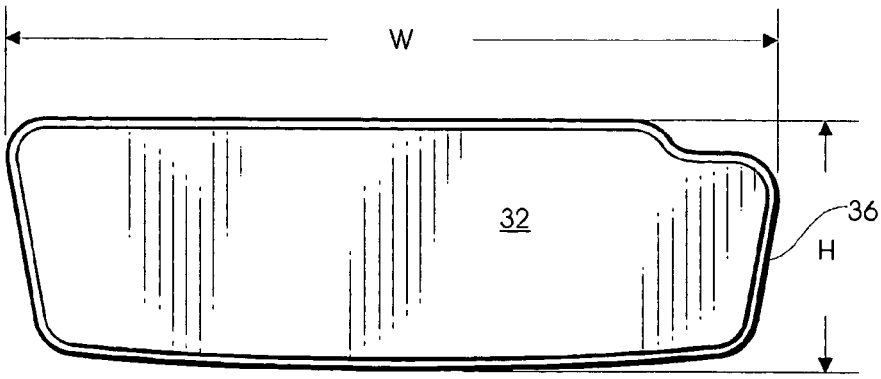
FIG. 4 is an enlarged front view of the face insert shown in FIG. 1.
Figure 5:
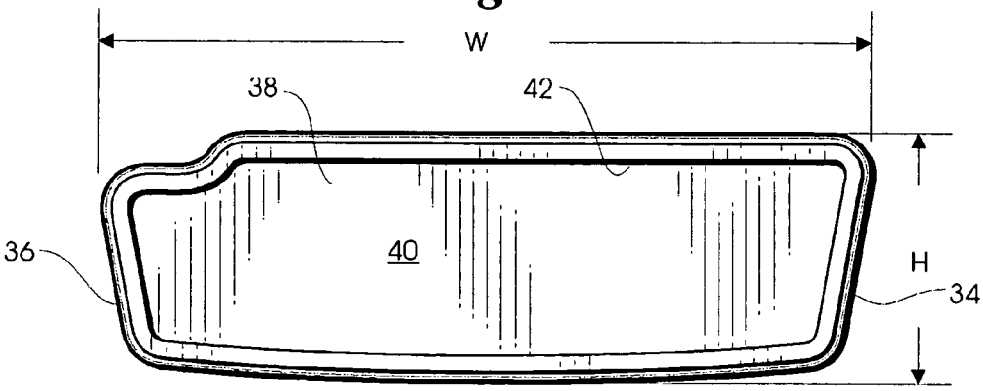
FIG. 5 is an enlarged back view of the face insert shown in FIG. 1.
Figure 6:
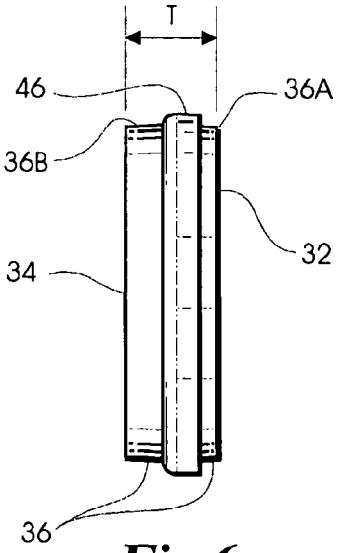
FIG. 6 is an enlarged end view of the face insert shown in FIG. 1.
Figure 7:
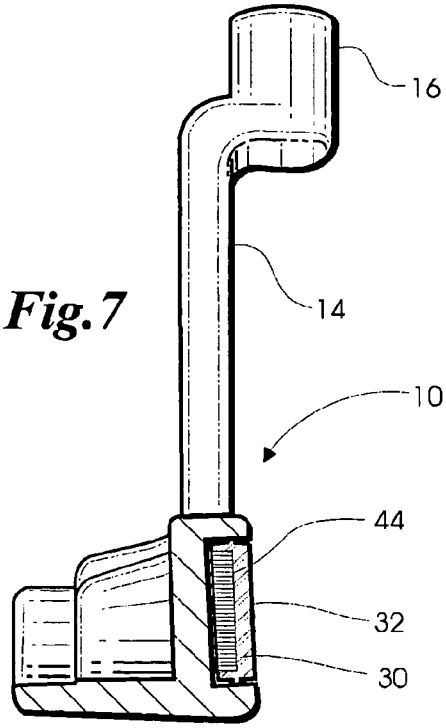
FIG. 7 is a cross sectional view taken along lines 7—7 of FIG. 3.

18, a heel end 20 and a toe end 22. The front face 18 has a first cavity 24 formed therein defined by a bottom wall 26 and a side wall 28. The body 12, including the first cavity 24, is typically formed by an investment casting process. The bottom wall 26 and side wall 28 are then shaped by a milling process to maintain precise tolerances. A first insert, hereinafter referred to as a face insert 30 is disposed in the first cavity 24. The body 12 is preferably made of a suitable metal such as steel, and the face insert 30 is preferably made of a polymer, more preferably an elastomeric polymer such as polyurethane. With additional reference to FIGS. 3, 4, and 5, face insert 30 has a generally trapezoidal shape with a front surface 32, a back surface 34 and a lateral surface 36. Back surface 34 has a second cavity 38 formed therein defined by a bottom surface 40 and a side surface 42. A second insert, hereinafter referred to as a back cavity insert 44 is disposed in the second cavity 38. Back cavity insert 44 is preferably made of a polymer having a hardness (durometer) and/or resiliency that is different from that of the face insert 30. In the illustrative embodiment, the face insert 30 is made of a polyurethane manufactured by BASF under the trademark ELASTOLLAN WY05352D-1, which is an elastomeric polyurethane having a density of 1.14 g/cm$^3$ and a Shore A hardness of 98. The back cavity insert is a silicone dielectric gel, or other highly resilient elastomer. The face insert 30 is formed by an injection molding process with a maximum width "W" of approximately 2.300 inches and a maximum height "H" of approximately 0.725 inch. The face insert 30 also has a thickness "T" of approximately 0.200 inch measured between the front surface 32 and the back surface 34 as shown in FIG. 6. The first cavity 24 has a depth of approximately 0.215 inch as measured between the front face 18 and the cavity bottom wall 26. The second cavity has a depth of approximately 0.100 inch measured between the back surface 34 and the bottom surface 40 of second cavity 38.

Figure 8:
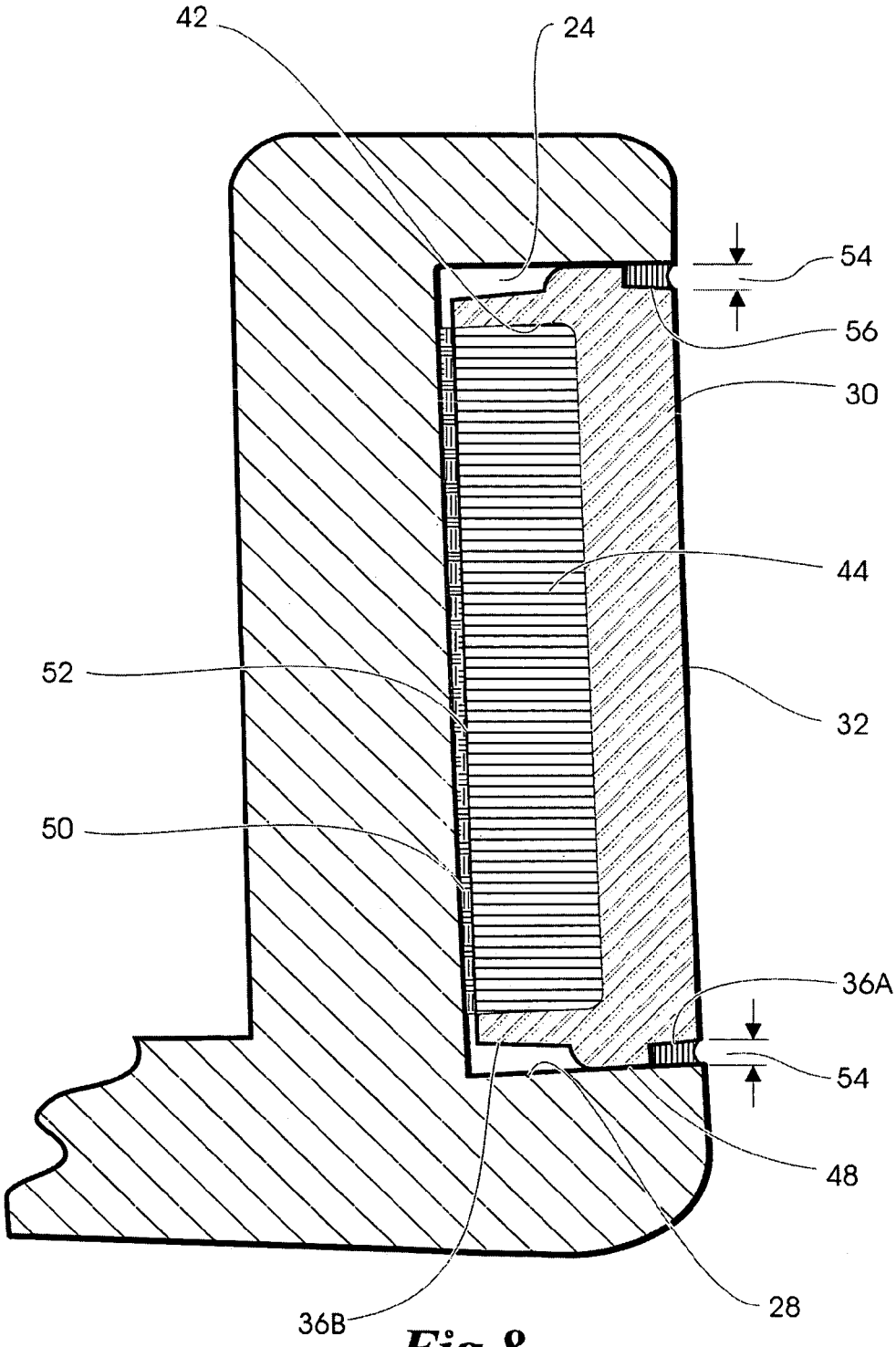
FIG. 8 is an enlarged cross sectional view of a portion of the golf club head shown in FIG. 7.

Face insert 30 further includes a continuous lip 46 extending outward from lateral edge 36 approximately 0.025 inch. Lip 46 separates lateral surface 36 into a forward portion 36A and a rearward portion 36B as seen most clearly in FIG. 8. The continuous lip 46 has an outer surface 48 that engages side wall 28 of first cavity 24 to center face insert 30 within first cavity 24.

Figure 9:
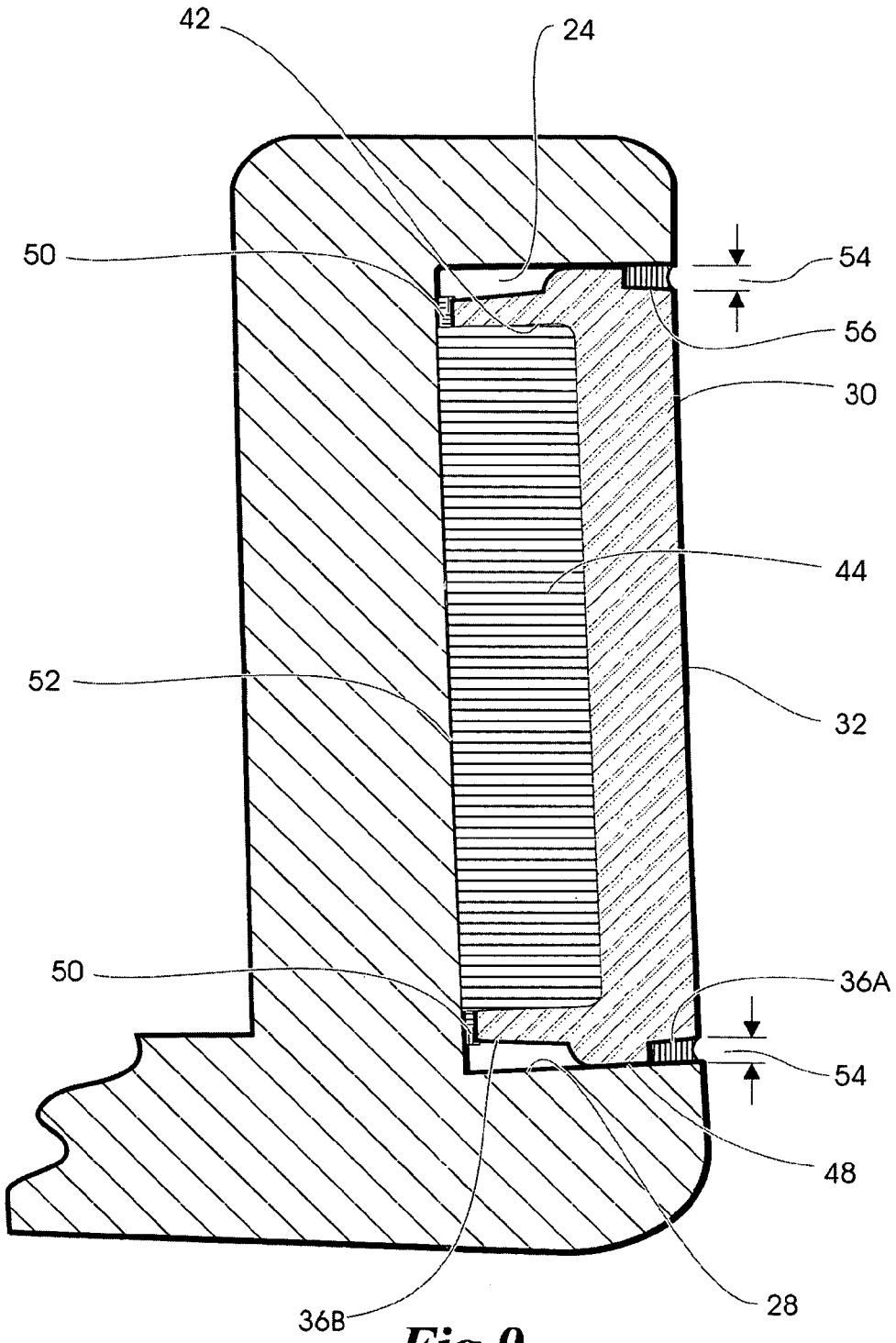
FIG. 9 is a cross sectional view of an alternative embodiment of the golf club head shown in FIG. 7.

Back cavity insert 44 may be cured in place within second cavity 38 or may be separately molded and attached by conventional means (e.g., adhesive) within second cavity 38. If back cavity insert 44 is cured in place, side surface 42 may be undercut or tapered inward so as to create a mechanical lock between back cavity insert 44 and face insert 30. Face insert 30 is thereafter attached to body 10 by adhesive means such as double sided tape 50, preferably a Double Coated Acrylic Foam or adhesive transfer film manufactured by 3M company, that is disposed between back cavity insert 44 and bottom wall 26 of first cavity 24. In the illustrative embodiment as shown most clearly in FIG. 8, double sided adhesive tape 50 is applied to exposed surface 52 of back cavity insert 44 before face insert 30 is installed in body 12. Double sided adhesive tape 50 is approximately 0.015 inch thick and is cut to a size and shape that matches exposed surface 52 of back cavity insert 44. A press is then used to install face insert 30 within first cavity 24. Finally the gap 54 between the forward portion 36A of lateral surface 36 and side wall 28 is filled with paint 56. Paint 56 is preferably a color that contrasts with the body 12 and the face insert 30 to provide a visual outline of the face insert 30. In an alternative embodiment as shown in FIG. 9, double sided adhesive tape 50 is cut to a size and shape that instead matches back surface 34 of face insert 30 allowing back cavity insert 44 to rest directly against bottom wall 26 of first cavity 24.

By providing a sealed second cavity within face insert 30 as disclosed in the present invention, it is possible to construct a face insert having the superior abrasion resistance and durability of the polyurethane face insert while having the composite hardness and resiliency of the face insert and softer back cavity insert. This enables the use of soft elastomeric back cavity inserts that would otherwise be unsuitable for use in golf club applications.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club head comprising:

a club head body composed of a first material, said club head body having a front face with a first cavity formed therein, said first cavity comprising side walls and a bottom wall;

a face insert composed of a second material disposed within the first cavity, and in contact with at least one of the side walls of the club head body said face insert comprising a body with a front surface, a back surface and a lateral surface, the back surface having a second cavity formed therein, the second cavity having a planar bottom surface and lateral walls defining a height and a width dimension of the second cavity, the second cavity comprising a recess the depth of which is less than both the height dimension and the width dimension; and a cavity insert comprising a body composed of a third material disposed in the second cavity.

2. The golf club head of claim 1, wherein:

said club head body is composed of metal.

3. The golf club head of claim 1, wherein;

said face insert is composed of a polymer.

4. The golf club head of claim 3, wherein:

said cavity insert is composed of a polymer having a lower durometer than said face insert.

5. The golf club head of claim 4, wherein:

said cavity insert is composed of a silicone compound.

6. The golf club of claim 1, further comprising:

an adhesive layer disposed between said club head body and said cavity insert.

7. The golf club of claim 1, wherein:

said face insert includes a continuous lip extending outward from the lateral surface of said face insert, the lip being adapted to center said face insert in said first cavity.

8. The golf club of claim 7, wherein:

said first cavity has a depth of approximately 0.215 inch; and said face insert has a thickness of approximately 0.200 inch.

9. The golf club of claim 8, wherein:

the lip extends outwardly approximately 0.025 inch from the lateral surface of said face insert.

10. A golf club head comprising:

a club head body composed of a first material, said club head body having a front face with a first cavity formed therein, the first cavity being defined by a bottom wall and a side wall;

a face insert composed of a second material disposed in the first cavity, said face insert having a front surface, a back surface and a lateral surface, the lateral surface having a continuous raised lip extending outwardly from the lateral surface of the face insert, only the raised lip of the face insert contacting the side wall of the first cavity to center said face insert within the first cavity, the back surface of said face insert having formed therein a second cavity defined by a planar bottom surface and lateral walls defining a height and a width dimension of the second cavity, the second cavity comprising a recess the depth of which is less than both the height dimension and the width dimension;

a cavity insert composed of a third material disposed in the second cavity such that said cavity insert does not contact the side wall of the first cavity; and an adhesive layer for adhering said face insert to said club head body disposed between said cavity insert and the bottom wall of the first cavity.

11. The golf club head of claim 10, wherein:

said face insert is composed of a polymer having a first durometer and hardness; and said cavity insert is composed of a polymer having a second durometer that is lower in value than said first durometer.

12. The golf club of claim 11, wherein:

the first cavity has a depth of approximately 0.215 inch; and said face insert has a thickness of approximately 0.200 inch.

13. The golf club of claim 11, wherein:

the lip extends outwardly approximately 0.025 inch from the lateral surface of said face surface toward the side wall of the first cavity.

14. A method of making a golf club head comprising:

providing a club head body composed of a first material, said club head body having a front face with a first cavity formed therein, the first cavity being defined by a bottom wall and a side wall;

providing a face insert composed of a second material said face insert having a front surface, a back surface and a lateral surface, the back surface of said face insert having formed therein a second cavity defined by a planar bottom surface and lateral walls defining a height and a width dimension of the second cavity, the second cavity comprising a recess the depth of which is less than both the height dimension and the width dimension;

providing a cavity insert composed of a third material disposed in the second cavity;

installing said cavity insert in said second cavity; and mounting said face insert in said first cavity with the lateral surface of the face insert in contact with the side walls of the first cavity and the lateral walls of the face insert interposed between the cavity insert and the club head body such that the cavity insert does not contact the side wall of the first cavity.

15. The method of claim 14, further comprising adhering said face insert to said club head body.

16. The method of claim 15, further comprising utilizing an adhesive layer between said club head body and said cavity insert.

17. The method of claim 16, wherein the adhesive layer does not contact said face insert.

18. The method of claim 14, further comprising:

providing an adhesive layer adapted to conform to the back surface of the face insert; and installing said face insert in the first cavity with the adhesive layer bonding the face insert directly to the bottom wall of the first cavity with the cavity insert trapped between the face insert and the bottom wall of the first cavity in direct contact with the bottom wall of the first cavity.

* * * * *